US010909887B2

(12) United States Patent
Neubauer et al.

(10) Patent No.: US 10,909,887 B2
(45) Date of Patent: Feb. 2, 2021

(54) PRODUCT LABEL WRISTBAND, METHOD OF MAKING, AND PRODUCT CONTAINER INCORPORATING SAME

(71) Applicant: SpinLabel Technologies, Inc., Boca Raton, FL (US)

(72) Inventors: Michael R. Neubauer, Miami, FL (US); Alan E. Shugarman, Las Vegas, NV (US)

(73) Assignee: SpinLabel Technologies, Inc., Boca Raton, FL (US)

( * ) Notice: Subject to any disclaimer, the term of this patent is extended or adjusted under 35 U.S.C. 154(b) by 0 days.

(21) Appl. No.: 16/038,140

(22) Filed: Jul. 17, 2018

(65) Prior Publication Data

US 2019/0019435 A1 Jan. 17, 2019

Related U.S. Application Data

(60) Provisional application No. 62/533,586, filed on Jul. 17, 2017.

(51) Int. Cl.

| | |
|---|---|
| ***G09F 3/10*** | (2006.01) |
| ***G09F 3/00*** | (2006.01) |
| ***G09F 3/02*** | (2006.01) |

(52) U.S. Cl.

CPC ..... *G09F 3/10* (2013.01); *G09F 3/005* (2013.01); *G09F 2003/0222* (2013.01); *G09F 2003/0239* (2013.01); *G09F 2003/0273* (2013.01)

(58) Field of Classification Search

None

See application file for complete search history.

(56) References Cited

U.S. PATENT DOCUMENTS

| | | | | |
|---|---|---|---|---|
| 3,148,820 | A * | 9/1964 | Robbins | B65D 5/4233 229/100 |
| 4,941,573 | A * | 7/1990 | Fuerstman | G09F 3/00 206/150 |
| 5,324,078 | A * | 6/1994 | Bane | G09F 3/10 281/2 |
| 5,639,529 | A * | 6/1997 | Gozdecki | G09F 3/10 40/306 |
| 9,842,517 | B1 * | 12/2017 | Amami | G09F 3/005 |
| 2012/0328817 | A1 * | 12/2012 | Franko, Sr. | G09F 3/0288 428/43 |
| 2014/0054183 | A1 * | 2/2014 | Ludwig | B65D 71/504 206/150 |
| 2015/0221239 | A1 * | 8/2015 | Couture | G09F 3/02 428/43 |
| 2016/0005339 | A1 * | 1/2016 | Waltersdorf | G09F 3/005 40/633 |
| 2017/0092160 | A1 * | 3/2017 | Kruchko | G09F 3/10 |
| 2017/0334618 | A1 * | 11/2017 | Kranker | G09F 21/02 |
| 2018/0018906 | A1 * | 1/2018 | Dellevigne | G09F 3/10 |

* cited by examiner

*Primary Examiner* — David R Dunn

*Assistant Examiner* — Christopher E Veraa

(74) *Attorney, Agent, or Firm* — Stanton IP Law Firm, P.A.

(57) ABSTRACT

A product label wristband includes a first adhesive covered by and in contact with a material and a second adhesive on the covering material on a side opposite that in contact with the first adhesive and a third adhesive that anchors the product label wristband to a product package or container. In another embodiment, the anchor adhesive is not required. The product label wrist band is peeled from the product package or container to form a wristband used to provide authorization for access to an event.

16 Claims, 11 Drawing Sheets

PRODUCT LABEL WRISTBAND, METHOD OF MAKING, AND PRODUCT CONTAINER INCORPORATING SAME

The present application claims the benefit of U.S. Provisional App. No. 62/533,586, filed Jul. 17, 2017, which is hereby incorporated by reference herein in its entirety.

BACKGROUND

Field

Embodiments relate event wrist bands. More particularly, embodiments relate to providing a product label at least a portion of which can be removed to form an event wristband.

Background

Wristbands are used often to indicate authorization for entry to events. Such wristbands can be made from numerous materials including, for example, paper, silicone, and plastic. The wristbands can be provided in numerous colors, and include graphics, and printing. However, such wristbands are generally provided as standalone items not coupled with another product. Further, often such wristbands are distributed without little or no promotion of sponsors of the events.

SUMMARY

A product label wristband includes a first adhesive covered by and in contact with a material and a second adhesive on the covering material on a side opposite that in contact with the first adhesive and a third adhesive that anchors the product label wristband to a product package or container. The product label wrist band is peeled from the product package or container to form a wristband used to provide authorization for access to an event.

In an embodiment, a product label wristband includes, a length of a first material having a first end and a second end, and a front surface and a back surface, a first adhesive deposited on the back side and at or near the first end of the length of material, a second material that covers the first adhesive such that the second material is in contact with the first adhesive, a second adhesive deposited on the opposite side of the material from where it contacts the first adhesive, and a third adhesive deposited on the back side and at or near the second end of the length of material.

In another embodiment, a product container includes a product label wristband that is affixed to the product container by a first adhesive, and wrapped around the product container and secured using a second adhesive, and wherein the product label wristband comprises a third adhesive that is covered by a material.

Because product label wristbands are affixed to products, they offer significant promotion of the products, the packaging or containers of which, the product label wristbands are affixed.

DETAILED DESCRIPTION

Figure 1:
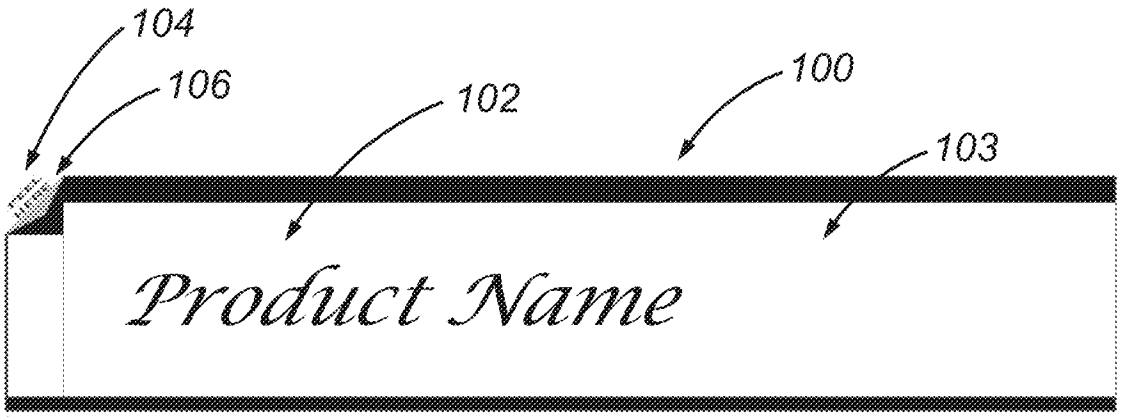
FIG. 1 illustrates a front surface of a product label wristband for providing event access authorization according to an embodiment.

FIG. 1 illustrates a front surface 103 of a product label wristband 100 for providing event access authorization according to an embodiment. In an embodiment, product label wristband 100 is made of a length of material to fabricate the product label wristband. The material can be any material for making product package and container labels, including for example, conventional roll-fed film labels, heat shrink labels and pressure sensitive labels. In an embodiment, product label wristband 100 may be waterproof and tearproof.

As shown in FIG. 1, front surface 103 of product label wristband 100 includes an area 102 for graphics, which can include any desired product information, such as product name and product logo. Any other desired information can be included in area 102 as well, including, for example, an identification of the event to which product label wristband 100 provides access authorization, and additional product information such as ingredients, nutritional information, and manufacturer information. Product label wristband 100 can also be created in any desired color or colors. Product label wristband 100 can also include no graphics or information, and can be simply one or more colors. Area 102 can extend the entire length of product label wristband 100 or a portion thereof.

Because product label wristband is designed to be a product label affixed to a product package or container, it includes a peelable portion 104. In an embodiment, attention is drawn to the presence of peelable portion 104 by an instruction, for example, the instruction "Peel here." In an embodiment, to facilitate removal of product label wristband 100, peelable portion 104 includes a flap 106 that makes grabbing product label wristband 100 easier such that peeling it from the product package or container is easier. In another embodiment, flap 106 is not an actual flop, but rather, is a graphic that looks like a flap to further indicate where the user is to peel product label wristband 100. Any product package or container can be used, for example, a product bottle in which the product is contained.

Figure 2:
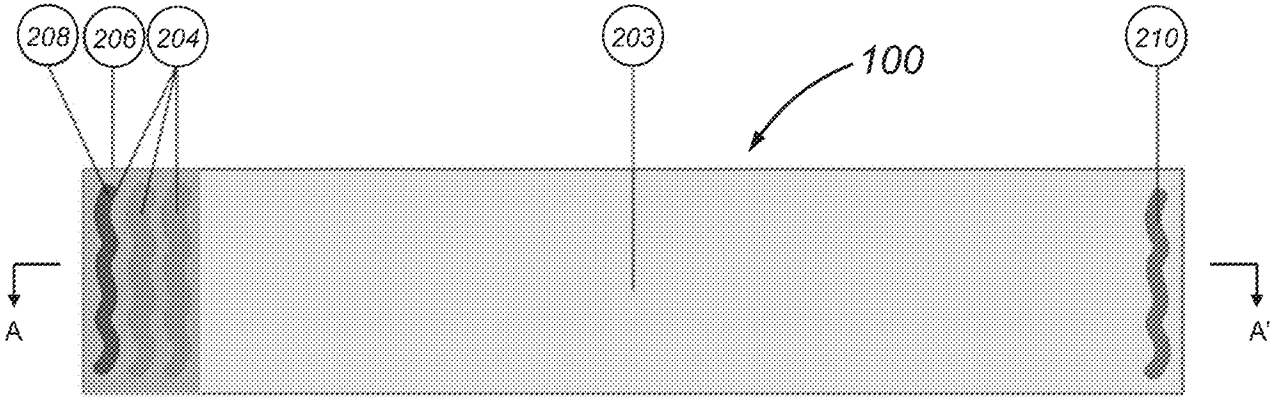
FIG. 2 illustrates a back surface of a product label wristband for providing access authorization to an event according to an embodiment.

FIG. 2 illustrates a back surface 203 of a product label wristband 100 for providing access authorization to an event according to an embodiment. As shown in FIG. 2, back surface 203 of includes adhesive deposited on each end of product label wristband 100. In an embodiment, any desired information or graphics can be included on back surface 203 of product label wristband.

In the embodiment illustrated in FIG. 2, an adhesive 204 is deposited on back surface 203 of product label wristband 100 at or near one end of product label wristband 100. In the embodiment illustrated in FIG. 2, adhesive strips 204 are configured as three adhesive strips. However, any number of adhesive strips 204 can be used in a particular application. Adhesive 204 does not have to be in the form of one or more strips. For example, depending upon application, adhesive 204 alternatively can be configured as adhesive strips, adhesive beads or dots, or an adhesive spread over an appropriate area, or some combination of these. These adhesive configurations can exhibit a placement pattern or no placement pattern as required by a particular application.

In an embodiment, adhesive 204 is a permanent adhesive such that when adhered to another portion of product label wristband 100 when wrapped around a person's wrist, as described below, removal of product label wristband 100 will require use of a sharp object such as scissors or a large amount of force.

On top of adhesive 204 is placed a material 206. In an embodiment, the surface of material 204 in contact with adhesive 204 is coated with a substance that facilitates separation of material 206 from adhesive 204. For example, in an embodiment, material 206 is a piece of wax paper, wherein the surface of the wax paper in contact with adhesive 204 is coated with a wax and the opposite surface of the wax paper is not coated with wax. Other materials can be used as material 206 as would be known to those skilled in the art. In the embodiment illustrated in FIG. 2, material 206 is placed on adhesive 204 such that the coated surface is in contact with adhesive 204 such that material 206 can be easily removed from adhesive 204.

As shown in FIG. 2, an adhesive 208 is deposited on the other side of material 206. In an embodiment, as described above, this other side of material 206 is not coated with a substance to facilitate separation of material 206 from adhesive 204. In the embodiment illustrated in FIG. 2, adhesive 208 is configured as a single adhesive strip deposited on the surface of material 206 that is not in contact with adhesive 204. However, any number of adhesive strips 208 can be used in a particular application. Adhesive 208 does not have to be in the form of one or more strips. For example, depending upon application, adhesive 208 alternatively can be configured as adhesive strips, adhesive beads or dots, or an adhesive spread over an appropriate area, or some combination of these. These adhesive configurations can exhibit a placement pattern or no placement pattern as required by a particular application.

In an embodiment, the force required to separate material 206 from adhesive 204 must be less than the force required to separate material 206 from adhesive 208. Further, the force required to separate material 206 from adhesive 204 should not be great enough to result in separation of material 206 from adhesive 208 when the product label wristband 100 is peeled off of a product package or container.

In an embodiment, the adhesive used in adhesive strip 208 is a permanent adhesive such that when adhered to another portion of product label wristband 100 when wrapped around a product package or container product label wristband 100 will stay securely wrapped around the product package or container. As described in more detail below when product label wristband 100 is peeled from a product package or container, adhesive 208 will maintain contact with material 206 such that material 206 is removed from adhesive 204 thereby exposing adhesive strips 204.

As shown in FIG. 2, an adhesive 210 is deposited on back surface 203 of product label wristband 100 at or near the end of product label wristband 100 that is opposite where adhesive 204 is deposited. Adhesive 210 is used to anchor product label wristband 100 to a product package or container for wrapping product label wristband 100 around the product package or container. In the embodiment illustrated in FIG. 2, adhesive 210 is configured as a single adhesive strip. However, any number of adhesive strips can be used to configure adhesive 210 in a particular application. Further, adhesive 210 does not have to be in the form of one or more strips. For example, depending upon application, adhesive 210 alternatively can be configured as adhesive strips, adhesive beads or dots, or an adhesive spread over an appropriate area, or some combination of these. These adhesive configurations can exhibit a placement pattern or no placement pattern as required by a particular application.

In an embodiment, adhesive 210 is a temporary adhesive that allows easy removal of product label wristband 100 from a product package or container. For example, in an embodiment, adhesive 210 can be a pressure sensitive hot melt adhesive commonly used to secure bank cards, such as credit card and debit cards, to a paper letter. Such an adhesive can be removed by peeling it off if desired prior to wrapping product label wristband 100 around a person's wrist. Alternative adhesives would be well known to those skilled in the art.

In an alternative embodiment, adhesive 210 is deposited on a product package or container to which product label wristband is affixed to provide an anchor for wrapping product label wristband 100 around the product package or container. In an embodiment, adhesive 210 is does not irritate human skin and is hypoallergenic or non-allergenic. In an embodiment, adhesive 210 can be deposited at one or more additional points along the length of product label wristband 100 to provide additional support.

Figure 3:
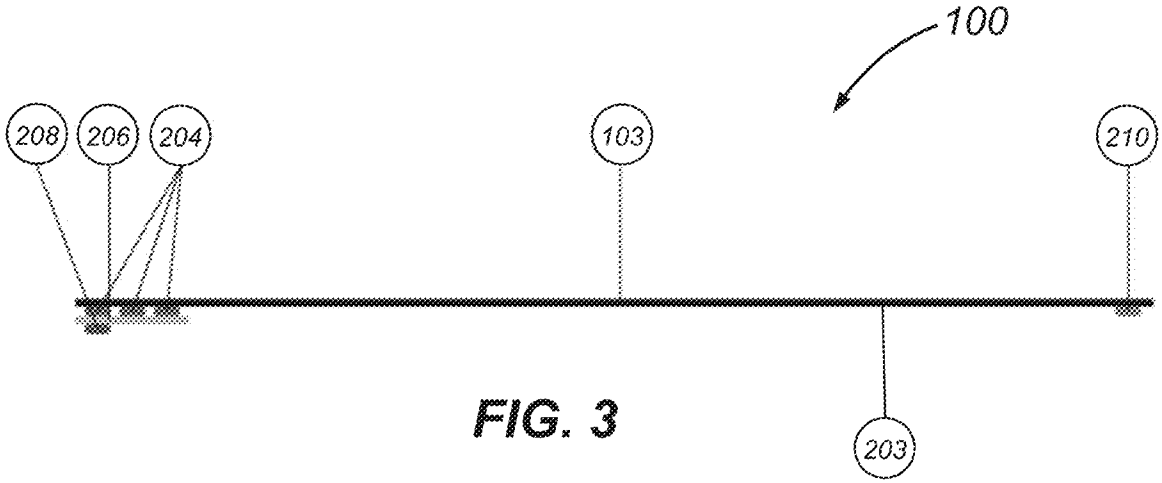
FIG. 3 illustrates a cross section of product label wristband taken at A-A' shown in FIG. 2 according to an embodiment.

FIG. 3 illustrates a cross section of product label wristband 100 taken at A-A' shown in FIG. 2 according to an embodiment. FIG. 3 illustrates adhesive 204 deposited on back surface 203 of product label wristband 100, material 206 placed to cover adhesive 204 (with coated side in contact with adhesive 204), adhesive 208 deposited on the other surface of material 206, and adhesive 210 deposited at or near the end of product label wristband 100 opposite the end at or near where adhesive 204 is deposited. When wrapped around a product package or container, adhesive 208 will attached securely to a portion of the front of product label wristband 100.

Figure 4B:
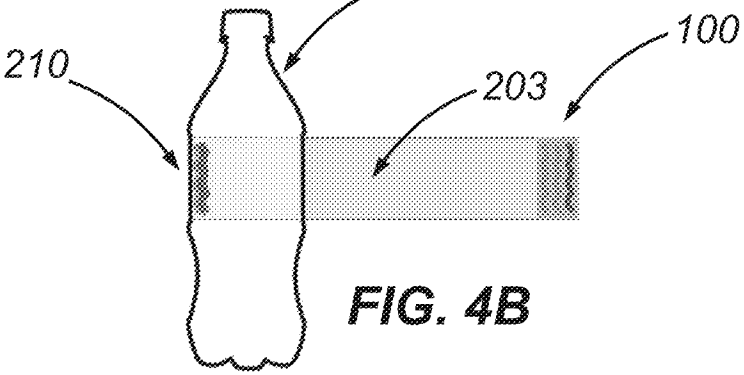
FIGS. 4A through 4E illustrate affixing a product label wristband to a product package or container and a binding seam that is formed when the ends of product label wristband 100 are attached to one another.
Figure 4A:
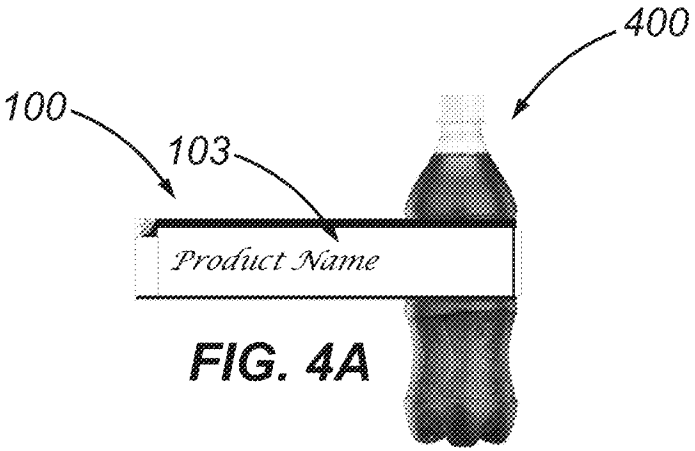
Figure 4D:
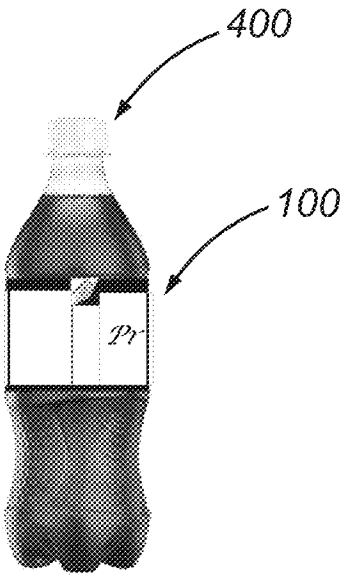
Figure 4C:
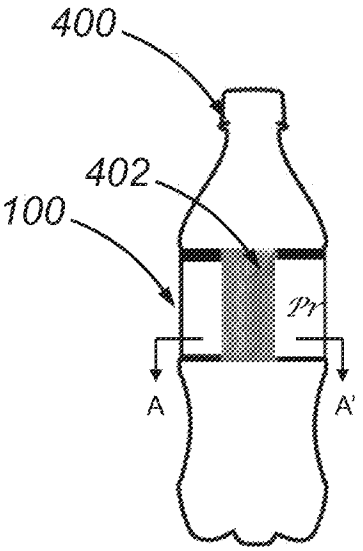

FIGS. 4A through 4E illustrate affixing a product label wristband 100 to a product package or container and a binding seam 402 that is formed when the ends of product label wristband 100 are attached to one another according to an embodiment. In the example illustrated in FIGS. 4A through 4E, the product package or container is a bottle 400 that contains the product. As shown in FIGS. 4A through 4E, to affix product label wristband, product label wristband 100 is affixed to bottle 400 using the end of product label wristband 100 with adhesive 210 (or alternatively to adhesive 210 previously deposited on bottle 400) as shown in FIGS. 4A and 4B. Product label wristband 100 is then stretched taut and wrapped around bottle 400 with adhesive 208 used to attach to front surface 103 to form a binding seam 402 that keeps product label wristband 100 securely wrapped around bottle 400 as shown in FIGS. 4C and 4D. In an embodiment, as described above, adhesive strip 208 is attached to the non-waxed side of piece of paper 206.

Figure 4E:
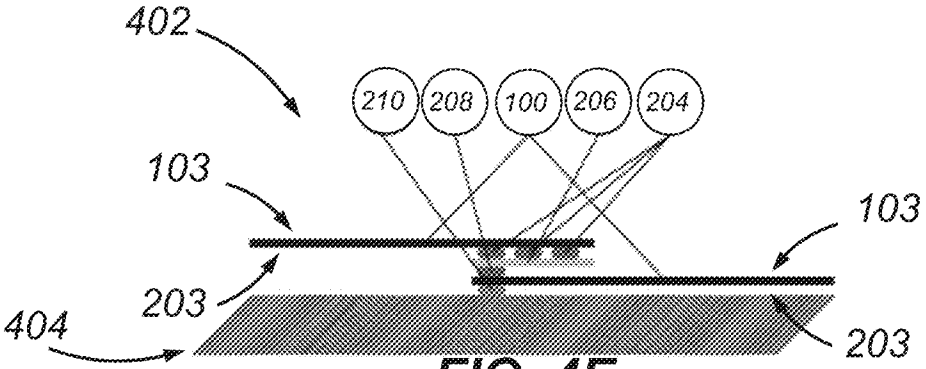

FIGS. 4C and 4E illustrate binding seam 402 that is formed upon attaching product label wristband 100 to bottle 400 and wrapping it around bottle 400 as described above. FIG. 4E illustrates a cross section of binding seam 402 taken at A-A' in FIG. 4C. As shown in FIG. 4E, binding seam 402 comprises adhesive binding 204 on back surface 203 of product label wristband covered by material 206 at or near one end of product label wristband 100, which end, using adhesive strip 208, is attached to the other end of product label wristband 100 at or near which is adhesive 210. Also shown in FIG. 4E is anchoring of product label wristband 100 to a surface 404 of bottle 400 using adhesive strip 210.

In another embodiment, adhesive 210 is not required. For example, where the product package or container has a grove that prevents product label wristband 100 from sliding off of the product package or container when wrapped upon itself as described above, the groove precludes the need for adhesive 210. Moreover, in such an embodiment, product label wristband 100 is free to rotate. As such, in another embodiment, product label wristband 100 can include a transparent window cut into it such that it can act as a rotating label to view portions of an underlying label as described for example, in U.S. Pat. No. 8,727,220, entitled, "Machine Readable Information Interface for a Container," which issued May 20, 2014, and which is hereby incorporated by reference herein in its entirety.

Another embodiment in which adhesive 210 is not required is where product label wristband 100 is heat shrink wrapped around a product package or container. In such a case, the tightening causes by the hear shrinking precludes the need for affixing product label wristband 100 to the product package or container.

Figure 5:
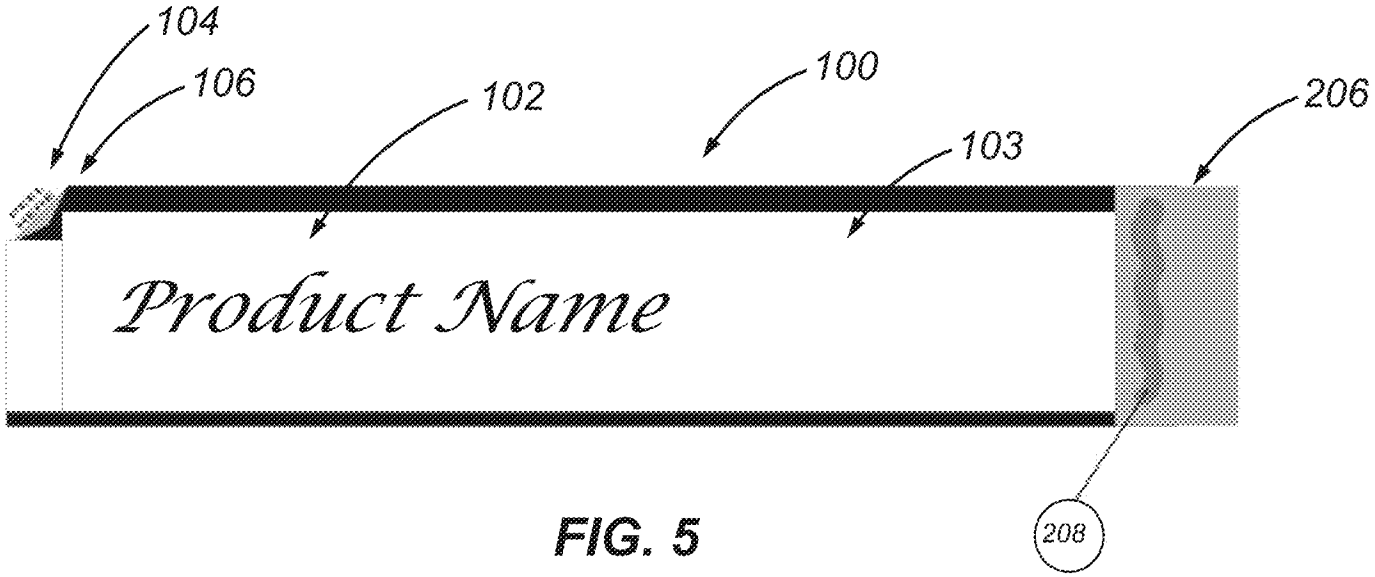
FIG. 5 illustrates the front of a product label wristband after it has been peeled off a product package or container by, for example, pulling flap 106.

FIG. 5 illustrates front surface 103 of product label wristband 100 after it has been peeled off a product package or container by, for example, pulling flap 106. As shown in FIG. 5, material 206 is affixed to adhesive 208 when product label wristband is peeled off. Material 206 remains affixed to adhesive strip 208 because the force to separate material 206 from adhesive 208 is greater than that required to separate material 206 from adhesive 204. In an embodiment, this is because the coated surface of material 206 is in contact with adhesive 204 and the uncoated surface of material 206 is in contact with adhesive 208.

Figure 6:
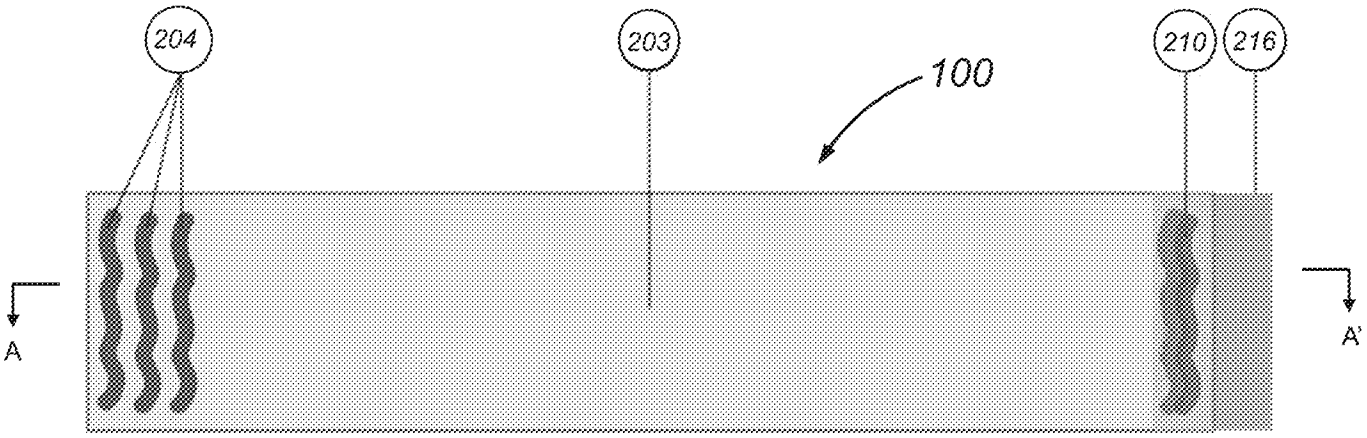
FIG. 6 illustrates the back of a product label wristband after it has been peeled off a product package or container by, for example, pulling flap 106.

FIG. 6 illustrates back surface 203 of product label wristband 100 after it has been peeled off a product package or container by, for example, pulling flap 106. As shown in FIG. 5, material 206 remains affixed to adhesive 208 when product label wristband is peeled off. As a result, adhesive 204 is exposed by removal of material 206 when product label wristband 100 is peeled off a product package or container. After peeling, product label wristband 100 can be wrapped around a person's wrist wherein back surface 203 is in contact with the person's skin. Adhesive 204 on back surface 203 of product label wristband 100 is used to affix the end of product label wristband 100 with exposed adhesive strips 204 to piece of paper 206 or another portion of the front 103 of the other end of product label wristband 100 to thereby securely wrap product label wristband 100 around the person's wrist.

Figure 7:
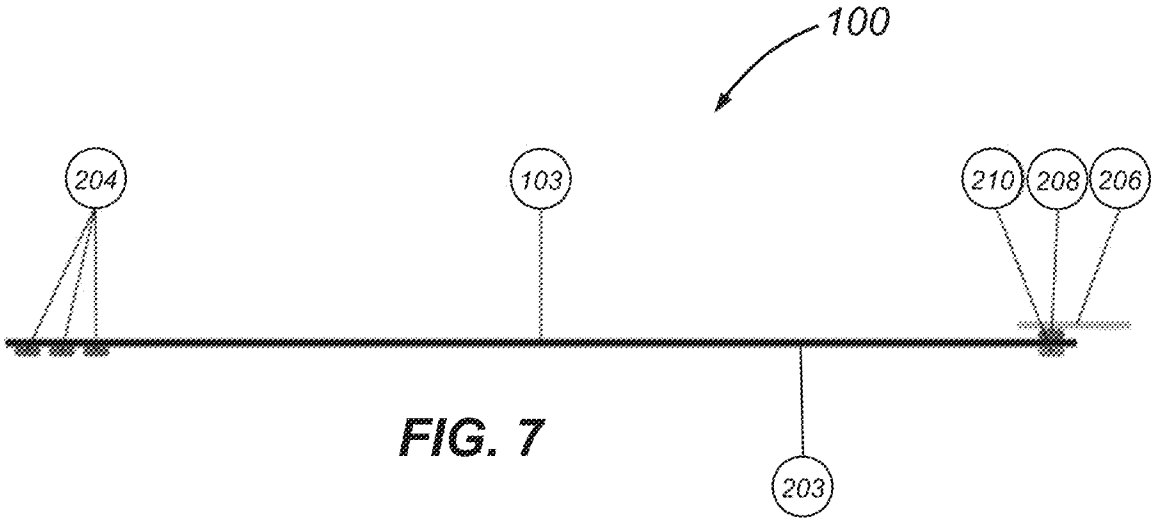
FIG. 7 illustrates a cross section of a product label wristband taken at A-A' shown in FIG. 6 after it has been peeled off a product package or container by, for example, pulling a flap according to an embodiment.

FIG. 7 illustrates a cross section of product label wristband 100 taken at A-A' shown in FIG. 6 after it has been peeled off a product package or container by, for example, pulling flap 106 according to an embodiment. FIG. 7 illustrates adhesive 204 deposited on back surface 203 of product label wristband 100 that is exposed by the process of peeling product label wristband 100 off of a product package or container and material 206 remaining affixed to adhesive 208, which can be wrapped securely around a person's wrist as described above.

In an embodiment, product label wristband 100 can cover a product's label or only a portion thereof. In either case, when product label wristband 100 is removed, the entire product's underlying label is the exposed. In an alternative embodiment, product label wristband 100 served as the product's label, such that when removed, no product label remains.

The length of the material for fabricating product label wristband 100 can depend on the product package or container but must be long enough to fit around a human's wrist. The width of material for fabricating product label wristband 100 can depend on the product package or container and any information desired to be included on product label wristband 100. For example, in an embodiment, product label wristband 100 has a length of 9.5 inches and a width of 2 inches. In this embodiment, piece of paper 206 has a length of 1 inch and a width of 2 inches. These dimensions can change depending on application.

Figure 8:
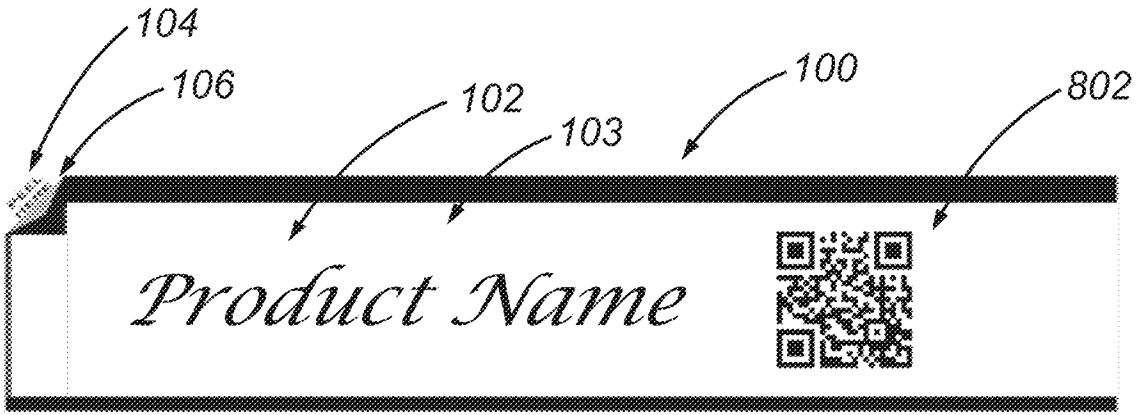
FIG. 8 illustrates a product label wristband that includes a QR code according to an embodiment.

In an embodiment, additional information can be added to front surface 103 or back surface 203 by any scanning technology, active or passive. Such scanning technologies include, without limitation QR codes and RFID codes. FIG. 8 illustrates a product label wristband 100 that includes a QR code 802 according to an embodiment. In the example illustrated in FIG. 8, accessing the QR code will direct the wearer to www.spinlabels.com. Any information can be included in the QR code.

Another applicable scanning technology is near field communication (NFC). With NFC, an NFC tag is embedded in product label wristband 100. When accessed with an NFC-enabled device, the NFC tag can cause information to be displayed on the NFC-enabled device, which can include a pass to allow entry into the event. Not only are such scanning technologies useful for providing additional information to wearers of product label wristband 100, but they also are useful for facilitating verification of authorization to enter an event. For example, the scan could be used to verify the wearer is on an authorized access list or to cause a display on an appropriately labeled device to display a pass authorizing entry into the event.

A product label wristband according to embodiments can also be used to trigger augmented reality (AR) applications. For example, product label wristband 100 can be configured with a graphic that acts as a code, or any other code, that is recognized by an AR application, which then causes some action to occur. For example, the action might be to cause the recognizing device to launch another application such as a web browser to take the user to a particular website. Another action that might be taken is to present a graphic on the recognizing device in which the user is immersed in the event to which product label wristband 100 provided access authorization. For example, where the event is a concert, such immersion could be in the form of projecting the user onto the stage where the event is taking place. Numerous actions can be envisions within the scope and spirit of the present invention.

Figure 9:
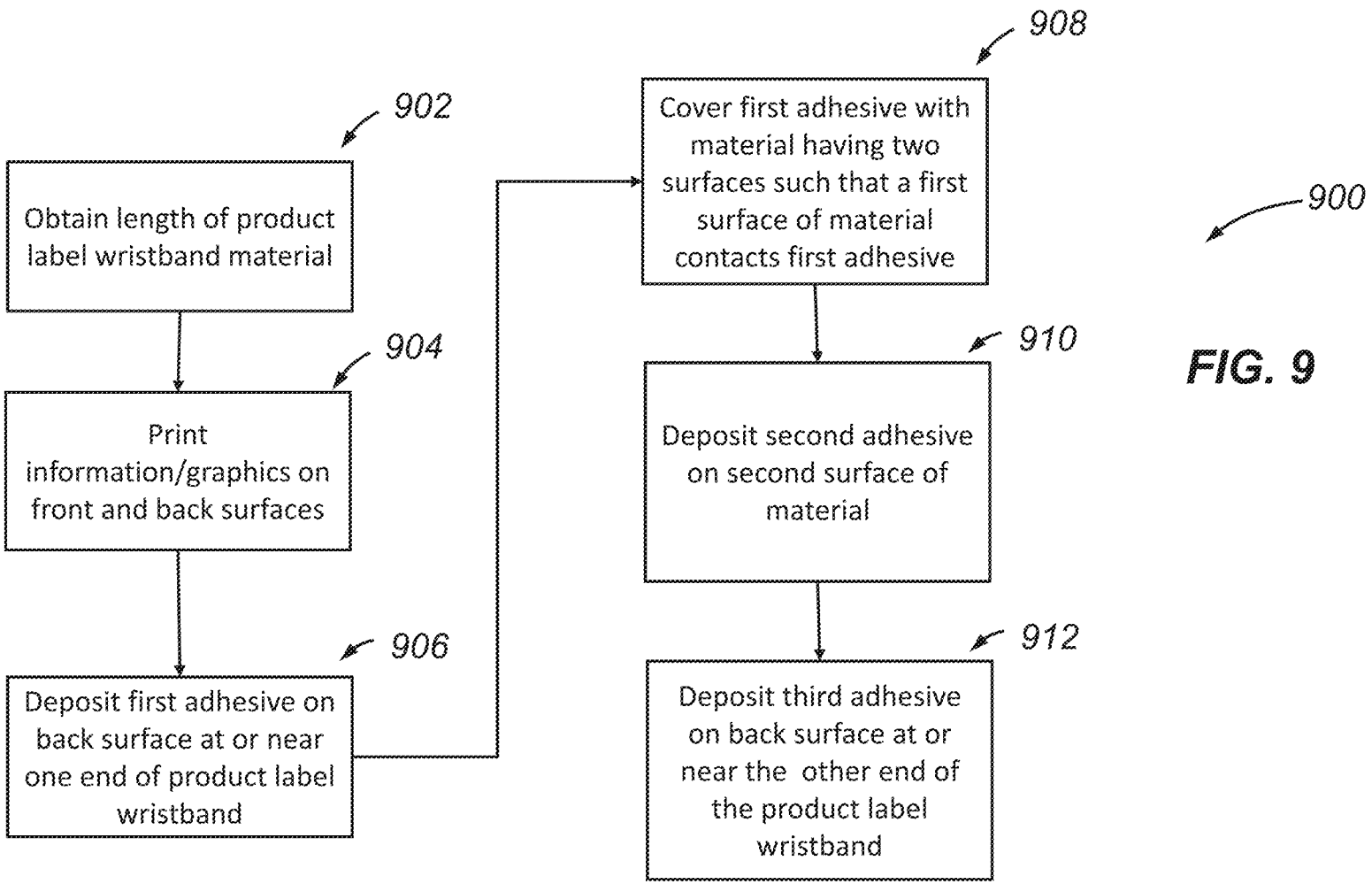
FIG. 9 is a flow chart for fabricating a product label wristband according to an embodiment.

FIG. 9 is a flow chart 900 for fabricating a product label wristband, such as product label wristband 100, according to an embodiment. In step 902, a length of product label wristband material is obtained to fabricate the product label wristband. The product label wristband material can be as described above. In step 904 any desired text, such an information and graphics, such as logos and/or designs, is printed in the front surface and/or the back surface of product label wristband. In step 906, a first adhesive, such as adhesive 204, is deposited on the back surface at or near one end of product label wristband. In step 908, the first adhesive is covered with a material having a first surface, and a second surface, wherein the first surface of the material contacts first adhesive. In an embodiment, as described above, the surface of the material in contact with the first adhesive is coated to lessen the adhesion between the material and first adhesive. In step 910, a second adhesive, such as adhesive 208, is deposited on the second surface of the material. In step 912, a third adhesive, such as adhesive 210, is deposited on the back surface of the product label wristband at or near the other end of the product label wristband at or near which the first adhesive is deposited.

Figure 10:
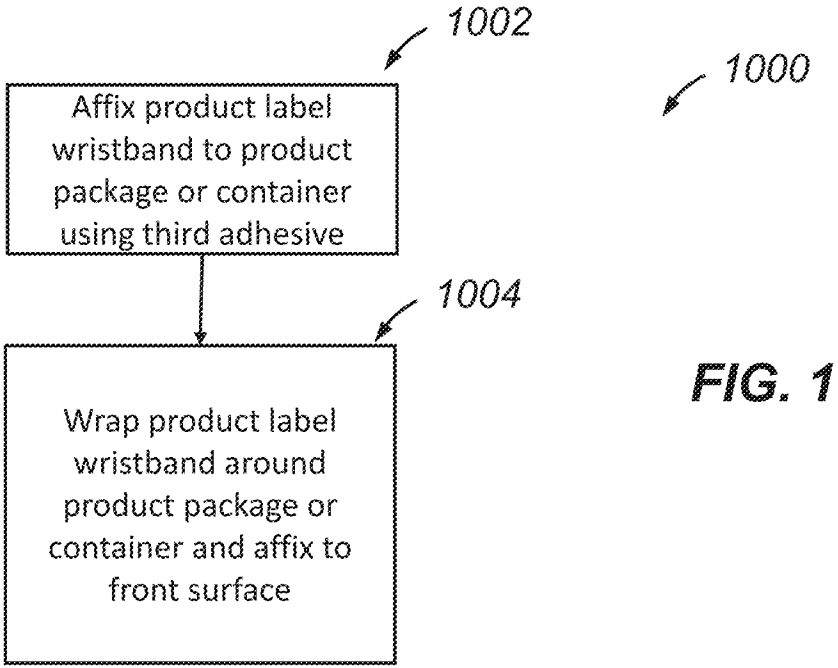
FIG. 10 is a flow chart for applying the product label wristband fabricated as described with respect to FIG. 9 to a product package or container according to an embodiment.

FIG. 10 is a flow chart 1000 for applying the product label wristband fabricated as described with respect to FIG. 9 to a product package or container according to an embodiment. In step 1002, the back surface of the end of the product label wristband with the third adhesive, such as adhesive 210, is affixed to the produce package or container. In step 1004, the product label wristband is pulled taut and wrapped around the product package or container such and affixed to the front surface of the product label wristband using the second adhesive, such as adhesive 208.

Due to the configuration of the product label wristband, adhesive strengths of adhesives used, and coated surfaces, when the product label wristband is peeled off of the product package or container, the material covering the first adhesive will be removed, thereby exposing the first adhesive. The product label wristband can then be wrapped around a person's wrist such that the first adhesive will attach the product label wristband to itself by securely attaching to the front surface of the product label wristband. Once securely wrapped around a person's wrist, the product label wrist band can be used for event entry authorization.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A product label wristband, comprising:

a length of a first material having a first end and a second end, and a front surface and a back surface;

a first adhesive deposited on the back surface and at or near the first end of the length of the first material;

a second material that covers the first adhesive such that the second material is in contact with the first adhesive;

a second adhesive deposited on the opposite surface of the second material from where the second material contacts the first adhesive, and configured such that when the product label wristband is wrapped around a product container and back onto itself, the second adhesive is in contact with the front surface of the first material to secure the product label wristband to the product container; and a third adhesive deposited on the back surface and at or near the second end of the length of the first material.

2. The product label wristband recited in claim 1, wherein the first and second adhesives are permanent adhesives, and the third adhesive is a temporary adhesive.

3. The product label wristband recited in claim 1, wherein the first adhesive is configured as three adhesive strips and the second and third adhesives are configured as single adhesive strips.

4. The product label wristband recited in claim 1, wherein the second material has a first surface and a second surface, wherein the first surface of the material is in contact with the first adhesive and wherein the first surface of the material has a coating that reduces the adhesion between the first surface of the material and the first adhesive.

5. The product label wristband recited in claim 1, wherein the second material is a wax paper that has a first surface and a second surface, wherein the first surface of the wax paper is coated with a wax and the second surface of the wax paper is not coated with a wax.

6. The product label wristband recited in claim 5, wherein the second surface of the wax paper has deposited thereon the second adhesive.

7. A product container, comprising a product label wristband that is affixed to the product container by a third adhesive, and wrapped around the product container and secured using a second adhesive, and wherein the product label wristband comprises a first adhesive that is covered by a material having a first side and a second side, wherein the first side is in contact with the second adhesive.

8. The product container recited in claim 7, wherein the first and second adhesives are permanent adhesives, and wherein the third adhesive is a temporary adhesive.

9. The product label container recited in claim 7, wherein the first adhesive is configured as three adhesive strips and the second and third adhesives are configured a single adhesive strips.

10. The product container recited in claim 7, wherein the second side of the material has a coating that reduces the adhesion between the second side of the material and the first adhesive.

11. A method for fabricating a product label wristband, comprising:

obtaining a length of a first material having a first end and a second end, and a front surface and a back surface;

depositing a first adhesive on the back surface and at or near the first end of the length of the first material;

covering the first adhesive with a second material such that the second material is in contact with the first adhesive;

depositing a second adhesive on the opposite surface of the second material from where the second material contacts the first adhesive such that when the product label wristband is wrapped around a product container and back onto itself, the second adhesive is in contact with the front surface of the first material to secure the product label wristband to the product container; and depositing a third adhesive on the back surface and at or near the second end of the length of the first material.

12. The method recited in claim 11, wherein the first and second adhesives are permanent adhesives, and the third adhesive is a temporary adhesive.

13. The method recited in claim 11, further comprising configuring the first adhesive as three adhesive strips and the second and third adhesives as single adhesive strips.

14. The method recited in claim 11, wherein the second material has a first surface and a second surface, wherein the first surface of the material is in contact with the first adhesive and wherein the first surface of the material has a coating that reduces the adhesion between the first surface of the material and the first adhesive.

15. The method recited in claim 11, wherein the second material is a wax paper that has a first surface and a second surface, wherein the first surface of the wax paper is coated with a wax and the second surface of the wax paper is not coated with a wax.

16. The method recited in claim 15, further comprising depositing the second adhesive on the second surface of the wax paper.

* * * * *